US006224693B1

(12) United States Patent
Garza-Ondarza et al.

(10) Patent No.: US 6,224,693 B1
(45) Date of Patent: May 1, 2001

(54) METHOD AND APPARATUS FOR SIMPLIFIED PRODUCTION OF HEAT TREATABLE ALUMINUM ALLOY CASTINGS WITH ARTIFICIAL SELF-AGING

(75) Inventors: Oscar Garza-Ondarza, Nuevo León; Salvador Valtierra-Gallardo, Coahuila; Juan Francisco Mojica-Briseño, Nuevo León, all of (MX)

(73) Assignee: Tenedora Nemak, S.A. de C.V., Garcia (MX)

( * ) Notice: Subject to any disclaimer, the term of this patent is extended or adjusted under 35 U.S.C. 154(b) by 0 days.

(21) Appl. No.: 09/458,347

(22) Filed: Dec. 10, 1999

(51) Int. Cl.[7] ..... C22F 1/04; C22F 1/043
(52) U.S. Cl. ..... 148/549; 148/698; 148/902
(58) Field of Search ..... 148/549, 698, 148/902

(56) References Cited

U.S. PATENT DOCUMENTS

| | | | |
|---|---|---|---|
| 2,117,948 | 5/1938 | Flammang et al. | 148/3 |
| 4,488,913 | 12/1984 | Ferton | 148/12.7 |
| 5,112,412 | 5/1992 | Plata et al. | 148/688 |
| 5,690,758 * | 11/1997 | Oh et al. | 148/700 |
| 5,788,784 | 8/1998 | Koppenhoefer et al. | 148/549 |
| 5,922,147 | 7/1999 | Valtierra-Gallardo et al. | 148/549 |

FOREIGN PATENT DOCUMENTS

| | | |
|---|---|---|
| 1506935 | 3/1975 | (GB) . |
| WO 94/28182 | 12/1994 | (WO) . |
| WO 96/10095 | 4/1996 | (WO) . |

OTHER PUBLICATIONS

ASM Handbook, vol. 2 (1990), entitled "Properties and Selection: Nonferrous Alloys and Special Purpose Materials", pp. ii(title), iv(©), xv (contents), & 15–41 ("Alloy and Temper Designation Systems for Aluminum and Aluminum Alloys" and "Aluminum Mill and Engineered Wrought Products"), tenth edition, published by ASM International.

ASM Handbook, vol. 4 (1991), entitled "Heat Treating", pp. i (title), ii (©), xii (contents), & 841–879, ("Heat Treating of Aluminum Alloys"), tenth edition, published by ASM International.

Metals Handbook, vol. 15 (1988), entitled "Casting", pp. i (title), ii (©), xii–viii (contents), 575, 577–579; 585–587, 589,. & 757–761 ("Design Considerations [riser & gating] "and "Aluminum and Aluminum Alloys"); 9th Edition, published by ASM International; Metals Park, Ohio.

* cited by examiner

*Primary Examiner*—George Wyszomierski
*Assistant Examiner*—Janelle Combs-Morillo
(74) *Attorney, Agent, or Firm*—A. Thomas Safford; Frommer Lawrence & Haug LLP

(57) ABSTRACT

Simplified heat-treatment in making aluminum alloys castings of the type improved by aging, especially for automotive engine cylinder heads and motor blocks. The castings, after solidification and extraction from their molds, each have an end product (workpiece) portion and a riser portion (the latter being ultimately cut off as waste). The workpiece portion of the casting is selectively quenched from solution temperatures down to about 120° C. by spraying water or other appropriate liquid preferably as a gas driven mist onto the surfaces of the workpiece while maintaining the riser portion of the casting essentially unsprayed at relatively significantly higher temperatures. After the quench, the residual reservoir of heat thus retained by said riser portion, by internal heat conduction, reheats the workpiece portion and maintains such workpiece portion for an effective time period within the temperature range for artificial aging, thus obviating any need for the aging furnace used by the prior art. Preferably, the quench is immediately after the casting mold extraction (without the standard natural cooling, reheating, and solution heat-treatment, all prior to quenching), thus obviating also the need for a solution heat-treatment furnace, required by the conventional prior art.

18 Claims, 3 Drawing Sheets

METHOD AND APPARATUS FOR SIMPLIFIED PRODUCTION OF HEAT TREATABLE ALUMINUM ALLOY CASTINGS WITH ARTIFICIAL SELF-AGING

FIELD OF THE INVENTION

The present invention relates to a method and apparatus for making aluminum alloys castings, wherein the heat-treatment processes of the prior art are simplified, by actually eliminating some traditional steps and equipment. The invention is applicable for example in the production of cylinder heads, motor blocks and the like, for automotive engines. The invention provides many advantages over the prior art heat-treatments, with an increased productivity of the casting plants, and lower capital and operation costs as well. The invention is particularly useful for producing aluminum alloys of the 3xx.x series of the classification of the Aluminum Association (AA), especially for T6 and T7 properties.

This invention is broadly applicable to the production of any aluminum alloy casting which in the past has derived meaningful benefit from quenching and artificial aging in an aging furnace. The invention eliminates the need for an aging furnace, while retaining the benefits thereof. This improvement has been styled herein as artificial self-aging (to distinguish from natural aging at ambient temperatures and from prior art artificial aging, which requires an aging furnace).

For a good background discussion and definitions of "heat treatable aluminum alloy castings", "artificial aging" (see also "precipitation hardening"), "quenching", "solution heat treatment", "casting series 3xx.x", and "T6 & T7 tempers" see the ASM Handbook series; particularly Volume 4 (1991), entitled "Heat Treating" (especially pages 841–879; see p.841 for "heat treatable", p. 851 et seq. for "quenching" and p. 859 for "age hardening") and Volume 2 (1990), entitled "Properties and Selection: Nonferrous Alloys and Special Purpose Materials", (especially pages 15–41; see p.39 for "heat treatable", p. 40 for "artificial aging") both being tenth editions, and also Volume 15 (1988), entitled "Casting" ninth edition (especially pages 757–761, see pp. 760-1 for "quenching" and "aging"); all published by ASM International; the contents of which (including also the patents cited below) are incorporated herein by reference.

The present invention uses a selectively directed spray quench in a manner which. eliminates expensive equipment and reduces significantly the overall production time. The castings are preferably so quenched promptly after demolding in accordance with applicants' own recent patent to obtain the properties of a conventional "solution" heat treatment (such as the properties required by a T6 temper) but without the usual "solution" heat treatment in a furnace.

This invention is broadly applicable to the production of any aluminum alloy casting of the type having significant precipitation hardening with meaningful benefit from "solution" heat treating and aging.

BACKGROUND OF THE INVENTION

In the production of cast parts made of aluminum alloys it has always been thought in the past to be necessary for many such castings (especially with a T6 or T7 temper) to undergo an elaborate heat-treating process in order to impart to the cast parts the necessary mechanical properties (like hardness and tensile strength required for the demanding working uses of said parts).

It is known that the degree of hardness and other mechanical properties of the cast parts depend on the thermal history of the cast parts after having been cast in the mold. The Aluminum Association (AA) has classified the most used aluminum alloys and the several standard heat treatments used in the industry. Examples of such standard heat-treatments those denominated T6 and T7, which designate a standard set of mechanical properties developed by certain castings of primarily silicon-copper-aluminum alloys.

The automotive industry throughout the world demands very strict quality standards. Casting plants making aluminum motor parts must therefore be able to produce cast parts which consistently comply with the minimum levels of mechanical properties specified for each part. Since quality is a must, the casting plants follow those procedures and processes which are well tested and have proven reliable for many years. The production process currently followed in the industry comprises filling a mold with liquid aluminum alloy, cooling the cast part in the mold in order to obtain a solidified casting, extracting the casting from the mold, and allowing the cast part to cool-down naturally to ambient temperatures, and then subjecting batches of such cooled castings to the aforementioned "solution" heat-treating process. One way to reduce the heat load in the solution heat treatment: furnace, has been to remove the sand cores and riser portions of the castings after natural cooling and before the "solution" heat treatment. The heat treating of the prior art comprises heating the preferably trimmed castings in a furnace to temperatures above about 470° C. (typically in the range between 480° C. and 495° C.) for a certain period of time, usually in the range between at least 2 to 7 hours. This treatment is performed in order to bring back into solid solution the copper and/or other alloying elements that give the castings their hardness. It is known that, while the casting metal is in the molten state, the alloying elements are in solution in the aluminum substrate. During the cooling process, particularly if the cooling is carried out at a slow rate, there is a tendency for the different elements to become segregated. Therefore, traditionally the casting is re-heated in a "solution" heat treatment furnace for several hours, and only then is quenched, i.e. rapidly cooled down by a fluid quench from a temperature for example about 480° C. to around 85° C., so that the solid solution is preserved (before segregation can occur). Such post solution-treatment quench cooling may commonly be continued in a manner sufficient to bring the castings down to any of a number of different temperatures and at different rates according to the final properties of the alloy to be emphasized.

This quenching step produces a supersaturated solid solution that causes the alloy to harden naturally as time passes. Finally, in order to accelerate and improve this age hardening, the quenched castings are maintained at temperatures of about 200° C. in an "aging" furnace for about 2 or more hours. The time spent in the "Eaging" furnace at elevated artificial aging temperatures brings the alloy to at least a partial coherency in its structure giving the required hardness and strength properties.

U.S. pat. No. 5,788,784 to Koppenhoefer et al. discloses a process for heat-treating light metal castings that requires "a solution heat treatment furnace 2, an adjoining quenching device 3, as well as an aging furnace 4", all particularly for cylinder heads of piston engines. In the U.S. Pat. No. 5,788,784 process, after solidifying and removing the casting from the mold, said castings unconventionally are not naturally cooled, yet are still solution heat treated (claiming the advantage of using the residual heat of the casting present at the approximate 530° C temperature of such treatment). Thereafter, the castings are quenched with an air/water mixture down to 130° C. to 160° C., and then aged in a furnace at approximately 170° C. to 210° C. (thus taking advantage of some relatively minor residual heat carryover into the aging furnace), and are then finally cooled to room temperature after, for example, four hours of furnace aging. The castings are individually quenched with a mist-type fine mixture of air and water, which is "nozzle sprayed on all sides" of the casting.

Koppenhoefer asserts a number of advantages by reason of quenching the castings with an air-water spray, for example that a uniform and low-distortion cooling is achieved, that the adhering core sand is not wetted at the elevated quenching temperatures and can be collected clean and reused after regeneration, and that the residual heat of the casting remaining at 130° to 160° C. can be used to aid in the subsequent furnace aging step (by not cooling down the casting too much and leaving some heat in said casting). Quenching the casting by directing the sprayed water on all sides of the casting suggests that most of the residual heat is lost, with that amount retained being mainly in the inner portion of the casting. This also suggests that a large temperature gradient would have to be maintained between the interior and the surface of the casting in order for the amount of retained residual heat carried over into the aging step to be meaningful. Such large differentials in temperature across the casting (particularly the end product portion thereof) is one of the problems to be avoided while quenching a piece in order to avoid stresses and achieve the T6 or T7 properties and also to avoid spheroidization of the alloying elements. Furthermore, Koppenhoefer does not teach or suggest applicant' invention of selectively quenching only the end product portion of the casting in order to use eventually the unquenched retained residual heat from the sprue and from any other temporarily retained waste portion of the casting (including sand cores) in order to enable aging of said casting without need for an aging furnace. In contrast, Koppenhoefer teaches decoring the resin bonded sand cores from the castings by being "pyrolytically destroyed" during solution heat treatment and further removed during quenching, all prior to aging.

U.S. Pat. No. 5,112,412 to Plata et al. teaches a process for cooling large cast billets of aluminum after a temperature homogenization (re-heat) annealing step. Annealing is a softening process for aluminum (just the opposite of the strengthening and hardening heat treatment of the present invention), and this Plata patent is silent on how the cooling is to be done to accomplish a particular result (mainly mentioning only that it be "in accordance with the alloy composition" and describing how the "automated and controlled manner of spraying can be adjusted to different shaped billets, as they may differ from the usual round shape"). This patent first describes cooling the annealed billet with a spray on all sides. This decreases the temperature at the surface of said billet, while the center portion (inaccessible to the spray) necessarily cools more slowly and thus initially remains at a relatively higher temperature. The billet leaves the spray and is allowed to equalize its internal and external temperatures in an insulated chamber. In another embodiment, Plata et al describes a process modification in the case of a so-called (but otherwise unidentified) "hard" alloy to continue spraying until the billet has achieved an equalized temperature. An example of this temperature is giver as "310 C.–350 C. in AlMgSi alloys" (a range above most age hardening but typical of softening annealing). The teaching includes the possibility of varying the intensity of the continuous spray, but only for the purpose of achieving a "better balanced heat flow" and a temperature zone "preferably distributed homogeneously during cooling so that no or only minimal deformations, stresses or cracks form". For example, the patent states that circular billets are sprayed evenly, but a rectangular billet may be sprayed with different intensity along it periphery. This difference in spray intensity is to achieve uniformity of cooling during the quench (just the opposite of subjecting the casting to a significant differential or complete absence of quench cooling of a specific waste portion of the casting in order to maintain such portion at a significantly higher temperature during the quench of the work portion (and much less to identify such a waste portion which is accessible to the spray, but is not to be so spray cooled). Thus, even though one of the embodiments discloses a spray process involving a difference in the temperature between certain portions of the billet which later reach an equalized temperature, there is no disclosure of differential quenching of selected portions of the casting to promote rather than minimize an initial significant heat differential between selected different portions of the casting (particularly with the division being between equally exposed waste and workpiece portions). Furthermore, Plata et al. teaches a process of cooling the surfaces of the workpiece (billet) on all sides, while the inner portion of the workpiece remains hot. If this process is applied to the workpiece portion of the castings for cylinder heads or blocks for engines, it will cause a different distribution of the alloying elements and thus it will fail to achieve the objects of the present invention (which provides a quenching step to produce uniform properties such as those obtained with a T6 treatment, all with accelerated aging but without the need for an aging furnace). In applicant' casting, the unquenched portion is an existing waste portion that is put to a useful interim purpose but whose ultimate alloy and physical properties are irrelevant. Engine castings, if made by the Plata process would be rejected.

Applicant' recent U.S. Pat. No. 5,922,147 (to Valtierra et al.), mentioned above, discloses an improved heat-treating method whereby the castings are quenched immediately after having been extracted from the mold, thus eliminating "solution" heat treatment and avoiding the need for a solution heat treatment furnace; while nevertheless producing castings with similar properties to those that undergo the traditional solution heating step. The U.S. Pat. No. 5,922,147 patent process provides a casting plant with greatly improved productivity and significant savings in capital and operational costs. This patent, however, does not teach or suggest a method capable of eliminating also the aging furnace.

OBJECTS AND SUMMARY OF THE INVENTION

The present invention improves upon the applicants' aforementioned U.S. Pat. No. 5,922,147 patent by simplifying even further the overall heat-treatment of the castings, although broadly it can be applied separately. The invention dispenses with the aging furnace, in addition to preferably also dispensing with the solution furnace. Therefore, it provides a method and apparatus for producing the casting in a considerably shorter time, with less capital, and lower production costs, while maintaining and even improving on required mechanical properties of the castings.

In order to better describe the invention, the applicants specifically identify the two major parts of the casting as a sprue portion (the riser portion being that portion which is subsequently removed and discarded) and a workpiece portion (the workpiece portion being the portion used for the end product). A "riser" is a reservoir of liquid metal used to largely compensate for shrinkage of a casting as it cools in its mold. The term "riser" also commonly has the meaning used in this application, namely the solidified metal portion of the casting remaining in the reservoir after the casting is cooled. "Riser portion" is intended to include at least the riser and additionally in its broader sense can include other similar waste attachments such as sprue, runners, gates, etc. formed as part of the original casting. When the casting is demolded from the typical water-cooled mold, the workpiece commonly has a temperature of about 400° C. and the riser one of about 500° C. The invention achieves its advantages by a selective quench of only the workpiece portion to surface temperatures preferably in the range from above about 100° C. to about 130° C., at a rate sufficient to achieve a supersaturated solution of the hardening element (typically copper) in the aluminum alloy of the workpiece at the atomic level. To perform this selective quench, spray nozzles are set to direct the water spray or mist on the workpiece and minimize any impingement on the riser. This workpiece-directed quench permits the riser (subjected only to natural or at most a minimized indirect cooling) to maintain a significantly higher temperature typically above about at least 300° C. to 350° C. during the workpiece quenching step. Thereafter, when the quenching is finished, the residual heat in the sprue portion is used as a heat reservoir to slightly re-heat the workpiece and maintain it (by conductive phenomena) in the artificial aging temperature range of between 140° C. and 250° C., and preferably about 180° C. to about 220° C., for an adequate time period, to thus achieve the desired properties for the workpiece. The invention dispenses with the need to supply furnace heat for re-heating and maintaining the whole casting in the artificial aging temperature range and simplifies the casting plant by thus rendering the aging furnace unnecessary. The final quench temperature should not be so low that the residual heat from the riser is too little to maintain the workpiece in the required aging temperature range for the necessary length of time. Also, if the workpiece surface temperature is maintained high enough above the boiling point of the spray liquid (typically water) throughout the quench, then liquid overflow onto the riser can be more easily minimized or avoided altogether and the latent heat of can be utilized and concentrated on the workpiece. A copious flow of a fine water mist is especially effective, since the mist particles evaporate immediately and there is no liquid wetting of the hot workpiece surface that can flow over onto the riser.

It has been found that. the existing riser mass as dictated by ordinary foundry practice is sufficient to achieve this result (i.e. provides an adequate heat reservoir for the artificial age hardening without need for an aging furnace); however, it would be within the scope of this invention to increase the mass as needed for the desired inventive result.

Even though the temperature of the workpiece and the riser greatly depends on the mass and the surface area of both portions, the quenching temperature can be regulated to achieve the advantages of the invention at different temperature paths. Also the aging position of the casting plant can be insulated to prolong the artificial aging step at elevated temperatures for a more extended time period as may be needed (or even make use of a heat exchanger to take advantage of other residual or excess heat sources that may be available elsewhere in the casting plant system), all as an aid to avoid the need for the added expense of an aging furnace.

It is therefore an object of the present invention to provide method and apparatus for producing aluminum alloy castings having similar mechanical properties as those produced by the prior art methods while avoiding the necessity of an aging furnace, and preferably also of a solution heat furnace.

It is a further object: of the invention to increase the productivity of a casting plant and to reduce its capital costs and its operating costs significantly.

Other objects of the invention will be evident to those skilled in the art or will be pointed out hereafter.

The invention is herein described as applied to the production of cylinder heads for automotive motors using generally silicon-based aluminum alloys of the AA 3xx.x series, having T6 and T7 properties (such as particularly A319), but it will be evident to those skilled in the art, that the invention can in its broader aspects be also applied to other metal alloys and to the heat-treating of other castings.

BRIEF DESCRIPTION OF THE DRAWINGS

In this specification and in the accompanying drawings, some preferred embodiments of the invention are shown and described and various alternatives and modifications thereof have been suggested; but it is to be understood that these are not intended to be exhaustive and modifications can be made without departing from the scope of the invention.

DETAILED DESCRIPTION OF PREFERRED EMBODIMENTS OF THE INVENTION.

Figure 1:
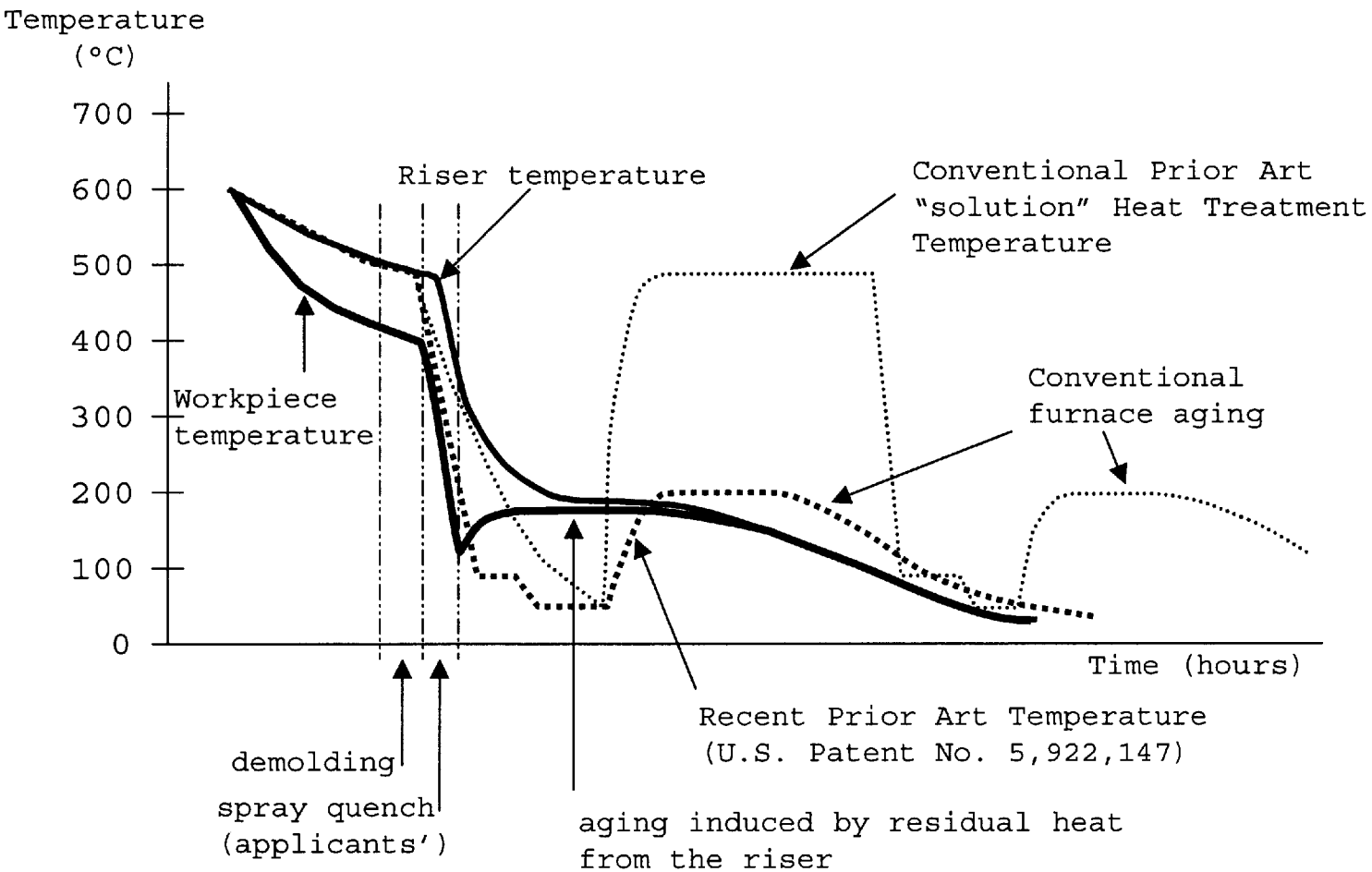
FIG. 1 is a graph showing the different casting temperature paths followed over time during the heat treatment according to the conventional prior art, according to applicant' most recent prior art process (shown on U.S. Pat. No. 5,922,147 to Valtierra et al.); and according to the present invention with respect to the workpiece portion and also to the riser portion.

FIG. 1 is a graph showing the different temperature paths vs. time of various castings; with the prior art processes in dotted lines and the present invention in continuous lines. Nowadays, the most common practice of the prior art (shown in the graph by the thinner dotted line) includes, after demolding, the steps of subjecting the casting to: natural cooling, reheating and maintaining in a solution heat furnace, quenching, and reheating and maintaining in an aging furnace. Another illustrated prior art temperature path (shown by the bold dotted line) is the heat treatment disclosed in applicant' own very recent U.S. Pat. No. 5,922,147 (wherein the solution treatment is omitted entirely, with the quenching of the casting occurring without natural cooling after demolding, and preferably immediately).

Also shown in the graph in FIG. 1, are the casting temperature paths of the workpiece portion and of the riser portion according to the present invention (shown in respective continuous lines). As it can be seen, there is a selective quenching of the workpiece portion of the casting. At the same time, the riser remains essentially unquenched, with any cooling typically occurring only naturally and at a much lower rate; so that when the quenched workpiece has a temperature of about 120° C., the riser still has Et temperature about 350° C. At about that point, before the quench reaches ambient temperature, the quenching step is stopped and the casting (riser and workpiece together) is allowed to homogenize its temperature with the workpiece being mainly in the range of from about 160° C. to about 220° C. (initially towards the high end of the range, preferably). This essentially duplicates the conventional temperature profile of a casting maintained in an aging furnace after the quenching step, while surprisingly eliminating the need for any aging furnace. This is possible, because there is sufficient mass in the riser to function as an adequate reservoir of heat available for a sufficient duration to achieve complete aging.

Figure 2:
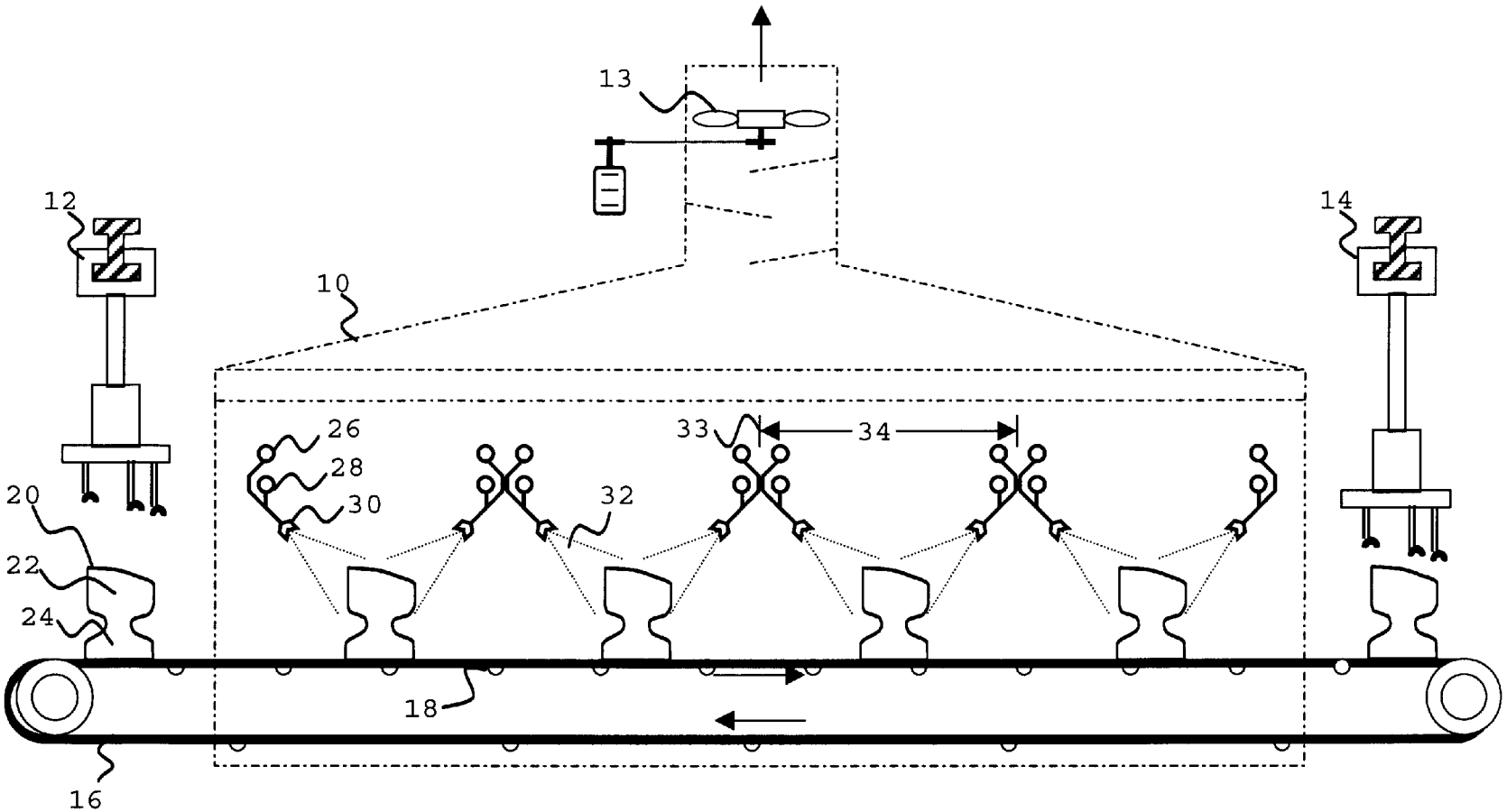
FIG. 2 is a schematic side elevational view of a preferred embodiment according to the present invention illustrating a series of stations making up the quench portion of a casting production line, showing some castings (each comprised of both the workpiece portion and the riser portion) and the spray nozzles used for quenching only the workpiece portion oriented uppermost.

FIG. 2 schematically shows a preferred embodiment of the apparatus used for the quenching step to perform the invention. Immediately after demolding, the casting 20, broadly comprising riser 24 and the workpiece 22, is placed on a conveyor 16 by means of a feeding robot 12. The conveyor 16 has structural supports 18 (such as rollers) located through the quenching unit 10. Also provided in the quenching unit 10 are an air header 26 and a water header 28, both being connected to spray nozzles 30. Spray nozzle 30 projects a water spray or an air driven mist 32 that is directed to impinge mainly on the workpiece portion 20 of the casting 22 positioned on the conveyor 16. Since rapid cooling rates are quite important to achieve the desired properties in the workpieces 20, and the nozzles 30 in this embodiment are in a fixed position within the quenching unit 10, the conveyor 16 is operated discontinuously in order to transport castings 20 from one quenching station 33 to the next in a step-wise mode (over a distance 34). After the castings 20 have traveled along the length of the conveyor 16 within the quenching unit 10, the residence time needed for quenching the workpieces 22 to the desired temperatures is completed. Finally, a withdrawing robot 14 transports the quenched castings to a place to be aged artificially at still elevated temperatures over an extended time utilizing the reservoir of heat remaining in the riser 24. In order to improve the quenching operation of the quenching unit 10, a fan 13 can be supplied to extract the vapor produced by the evaporation of the sprayed water while quenching the workpieces 22 of castings 20.

Figure 3:
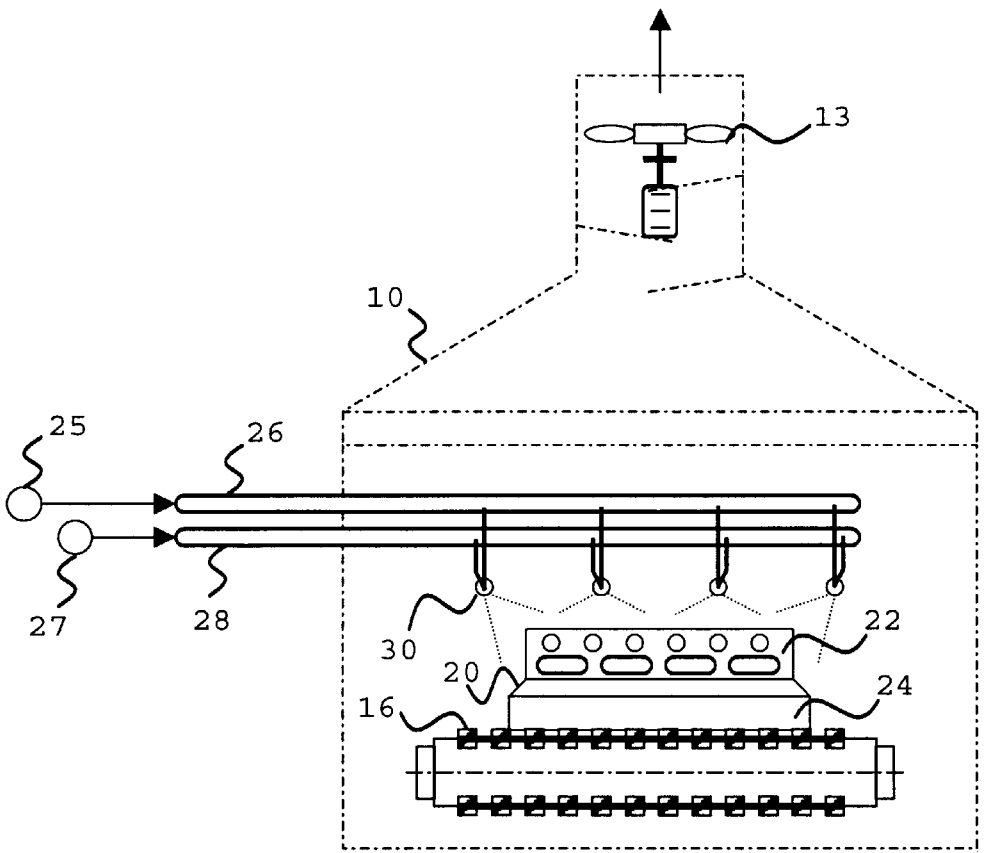
FIG. 3 is a schematic frontal view of the embodiment shown in FIG. 2, showing the nozzles directing the spray or mist selectively onto the workpiece portion of the casting.

FIG. 3 shows an end view of the quenching unit 10. The same elements bear the same reference numerals of FIG. 2. Additionally shown is an air supply 25 for air header 26, preferably at high pressure in order to achieve a better water spray or mist. Liquid supply 27 feeds header 28, which can handle water or any other suitable liquid cooling medium.

Even though the process described on FIGS. 2 and 3 teaches a quenching unit for processing castings 20 in a step-wise mode and with the riser 24 oriented as the base of the casting 20, it will be evident to those skilled in the art that the quenching unit 10 of the invention could be operated continuously preferably with moving headers and spray nozzles or in a batch processing system as well. Another change that can be performed to the embodiments of the invention without departing from its scope comprises locating the spray nozzles below the castings thus directing the spray 32 upwardly. In this case, the sprue portion 24 of the castings 20 would be positioned above the workpiece 22.

As previously indicated, the invention in its broader aspects can be applicable to other aluminum alloys and heat treating processes wherein the aging furnace step is normally used, including those prior art systems still using a conventional solution heat treatment with a subsequent quenching step.

What is claimed is:

1. A method of quenching and artificially aging an aluminum alloy casting having a riser portion and a workpiece portion, said method comprising:

selectively quench cooling the workpiece portion of the casting while maintaining the riser portion at a relatively higher temperature;

initiating the quench when the casting is at elevated temperatures with its alloying elements in solid solution;

proceeding with the quench to cool the workpiece portion sufficiently rapidly to inhibit precipitation of the alloy elements and thereby to maintain such elements in supersaturated solution within the aluminum matrix, discontinuing the quench when the workpiece portion is cooled to a temperature which is at or below the range for artificial aging;

artificially aging said workpiece portion within a range of temperatures and over an effective time period appropriate for such aging of the aluminum alloy casting workpiece primarily by means of residual heat flowing from the riser portion.

2. A method according to claim 1, wherein the mass, shape and the cross-sectional area of attachment of the riser portion relative to the workpiece portion and the temperature differential therebetween are chosen to be sufficient to maintain the workpiece portion within the temperature and time period ranges required for the artificial aging.

3. A method according to claim 2, wherein said quench is by a water spray or mist and is initiated when the casting is at a temperature above about 350° C., is less than five minutes duration, and is discontinued when the workpiece portion reaches a temperature on the order of 100° C. to 130° C., while the riser portion remains above 300° C., and the workpiece portion is then artificially aged in the range of 180° C. to 220° C. by using at least primarily the available heat content from the riser portion, which time period extends within a range of from about 2 to about 5 hours.

4. A method according to claim 2, wherein said casting is insulated during artificial aging to prolong the duration of the artificial aging process without added heating.

5. A method of quenching and artificially aging a heat treatable aluminum alloy casting having properties, including hardness and strength, which are improved by precipitation hardening through aging, said method comprising:

quench cooling a portion of the casting, which has a still attached riser portion in addition to a workpiece portion, by selectively subjecting the workpiece portion of said casting to such quench largely to the exclusion of the riser portion, initiating the quench when the casting is at temperatures above the point where a hardening element of the alloy begins to precipitate out significantly, proceeding with the quench so as to cool the workpiece portion at a rate sufficiently rapid to inhibit precipitation of the hardening element and thereby to maintain the element in supersaturated solution within the aluminum matrix, discontinuing the quench when the workpiece portion is cooled to a temperature which is at or below the range for artificial aging temperatures and which will result in the workpiece being in the artificial aging temperature range for an effective extended time period;

effecting such artificial aging of said workpiece portion within said range primarily by reason of the residual heat from said riser portion transferring to the quenched workpiece.

6. A method according to claim 5, wherein said selective quenching is performed by spraying a quenching fluid on the surfaces of said workpiece portion.

7. A method of making aluminum alloys castings according to claim 6, wherein said quenching fluid is water.

8. A method according to claim 7, wherein said quench is initiated when the casting is at a temperature above about 350° C., the quenching is discontinued when the workpiece portion reaches about 130° C. while the riser portion remains above 300° C., and the artificial aging is in the range of 180° C. to 220° C.

9. A method according to claim 7, wherein said quench is initiated when the casting is at a temperature above about 350° C., the quenching is discontinued when the workpiece portion reaches about 120° C. while the riser portion remains above 300° C., and the artificial aging is in the range of 180° C. to 220° C., and also wherein said workpiece is decored after the artificial aging.

10. A method according to claim 5, wherein said artificial aging is at a temperature between 140° C. and 250° C. for a period of time from about two to five hours.

11. A method according to claim 8, wherein said artificial aging is for a period of time from two to five hours.

12. A method according to claim 11, further comprising:

solidifying and removing the casting from its mold while said casting is at a temperature above 400° C.;

heating said castings in a solution furnace to solution heat treating temperatures for a time period from about 2 to 7 hours.

13. A method according to claim 12, wherein said heating of said castings in a solution furnace is to a range of solution heat treatment temperatures from about between 480° C. and 495° C.

14. A method according to claim 13, further comprising naturally cooling the casting after extraction from its mold and before solution heat treating said castings.

15. A method according to claim 5, wherein quenching said workpiece portion is less than about 5 minutes.

16. A method according to claim 11, wherein quenching said workpiece portion is less than about 4 minutes.

17. A method according to claim 5, wherein said casting is formed from an aluminum alloy of the 3xx.x series according to the Aluminum Association (AA) classification having Al, Si, & Cu or Mg as the principal casting constituents, with properties at least equal to a T6 or T7 temper.

18. A method according to claim 17, wherein said casting is made from an A319 aluminum alloy w ith up to a 5% copper content.

* * * * *

UNITED STATES PATENT AND TRADEMARK OFFICE

CERTIFICATE OF CORRECTION

PATENT NO. : 6,224,693 B1
DATED : May 1, 2001
INVENTOR(S) : Oscar Garza-Ondarza et al.

It is certified that error appears in the above-identified patent and that said Letters Patent is hereby corrected as shown below:

Column 4,
Line 64, replace "sprue" by -- riser --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*